US007607566B2

(12) United States Patent
Philips et al.

(10) Patent No.: US 7,607,566 B2
(45) Date of Patent: Oct. 27, 2009

(54) SHIPPING AND DISPLAY CONTAINER AND CONTAINER BLANK

(75) Inventors: Nicholas A. Philips, Sugar Grove, IL (US); Jeffrey A. Smith, Medford, NJ (US)

(73) Assignee: International Paper Co., Memphis, TN (US)

( * ) Notice: Subject to any disclaimer, the term of this patent is extended or adjusted under 35 U.S.C. 154(b) by 80 days.

(21) Appl. No.: 11/393,478

(22) Filed: Mar. 30, 2006

(65) Prior Publication Data

US 2007/0228132 A1 Oct. 4, 2007

(51) Int. Cl.
*B65D 5/10* (2006.01)
*B65D 17/28* (2006.01)

(52) U.S. Cl. ..... 229/157; 229/242; 229/915

(58) Field of Classification Search ..... 229/157, 229/158, 240, 242, 915, 916, 918, 919; 206/427
See application file for complete search history.

(56) References Cited

U.S. PATENT DOCUMENTS 2,757,853 A * 8/1956 Main ..... 229/117.17
3,178,096 A * 4/1965 Reeves et al. ..... 229/117
3,780,934 A * 12/1973 Gardner ..... 229/117.15
4,000,811 A * 1/1977 Hardison et al. ..... 229/242
4,318,474 A * 3/1982 Hasegawa ..... 206/428
4,709,852 A * 12/1987 Stoll ..... 229/119
4,946,042 A * 8/1990 Ferreri et al. ..... 229/241
5,139,196 A * 8/1992 Fry et al. ..... 229/157
5,318,220 A * 6/1994 Gagliardo ..... 229/157
5,662,508 A * 9/1997 Smith ..... 446/128
6,234,385 B1 * 5/2001 Espinoza et al. ..... 229/122

* cited by examiner

*Primary Examiner*—Gary E Elkins

(57) ABSTRACT

A container and its associated container blank for shipping and displaying products. The container blank includes a plurality of side panels, bottom panels, and top panels that are erectable into a fully enclosed shipping container. Formed in some of the side panels and some of the top panels are removable punch-out window panels. When removed, the punch-out window panels leave a top panel that defines a periphery around the "window" area. Various stacking tabs and slots are configured in the bottom panels. The stacking tabs and stacking slots are positioned such that when engaged and the containers are in a vertically stacked arrangement, the stacking tabs bias against a portion of the periphery of the top panel. When not engaged, the container has a flat bottom.

14 Claims, 13 Drawing Sheets

20

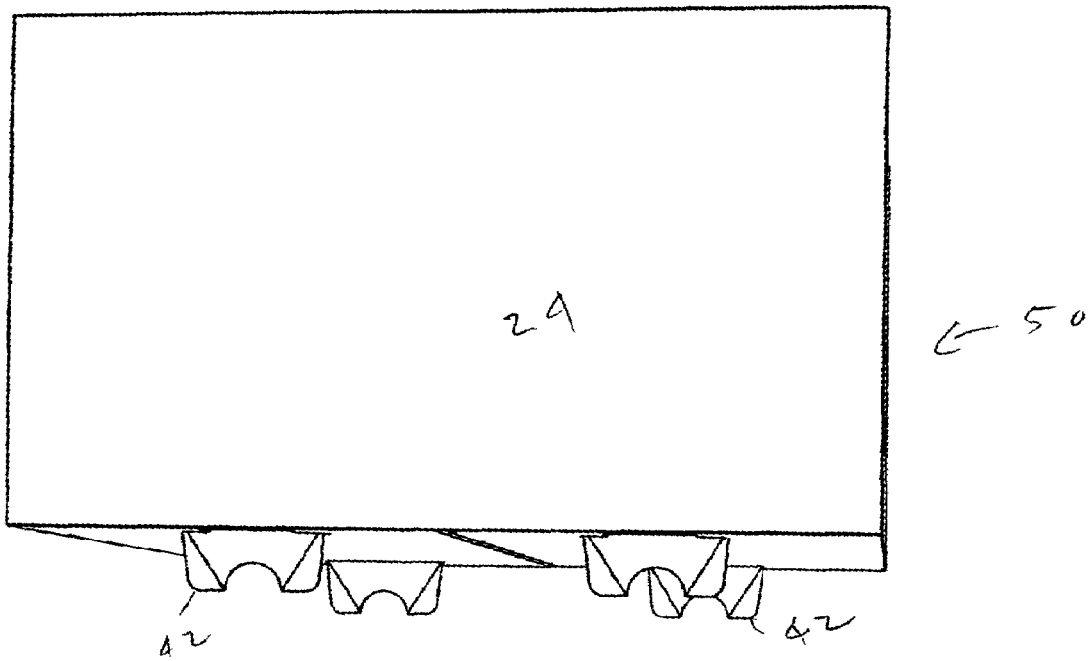
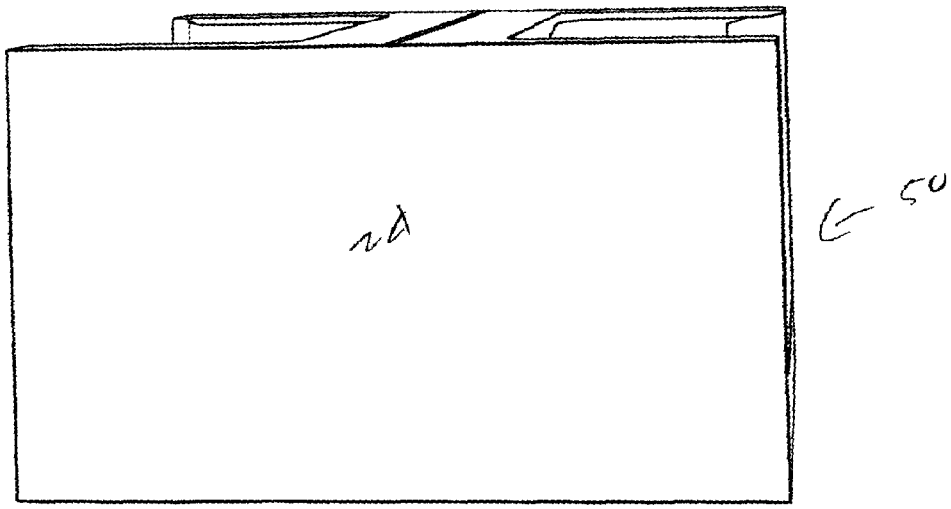
FIG 11

SHIPPING AND DISPLAY CONTAINER AND CONTAINER BLANK

FIELD OF THE INVENTION

This invention relates generally to blanks and their resulting containers and more specifically to blanks and containers having viewing windows and stacking tabs.

BRIEF DESCRIPTION OF THE DRAWINGS

The invention is best understood from the following detailed description when read in connection with accompanying drawings. It is emphasized that, according to common practice, various features of the drawings are not to scale. On the contrary, the dimensions of various features are arbitrarily expanded or reduced for clarity. Included in these drawings are the following figures:

FIG. 4 is another perspective view of a further assembled container made from the container blank of FIG. 1;

FIG. 11 is a side perspective view of the second container arrangement as depicted in FIG. 10;

DETAILED DESCRIPTION

The present invention will now be described with reference to the accompanying drawings. The present invention is directed to a blank 20 and container 50 that utilizes a unique tab-in window arrangement to provide stacking stability. One suitable embodiment of the blank 20 and container 50 are constructed in accordance with aspects of the present invention as illustrated in FIGS. 1 and 3 through 14. Additionally, an alternative embodiment of the present invention is depicted in FIG. 2. Specific details of the blank 20 and the resulting container 50 are described in more particularity below.

Figure 1:
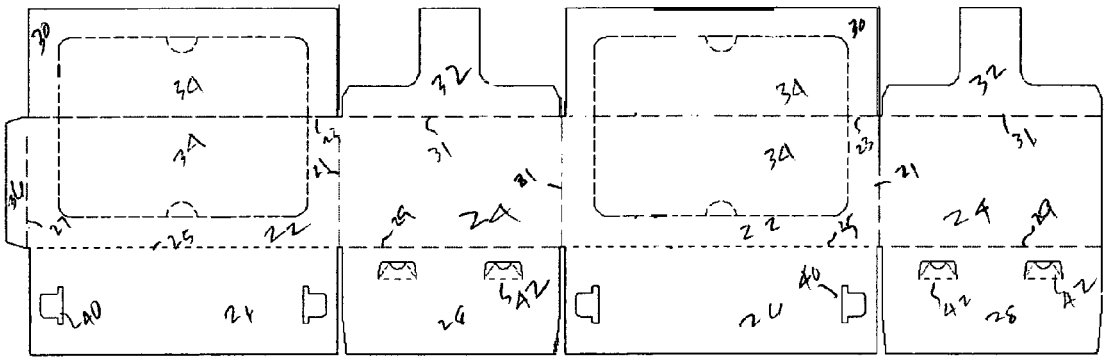
FIG. 1 is a plan view of an exemplary container blank.
Figure 2:
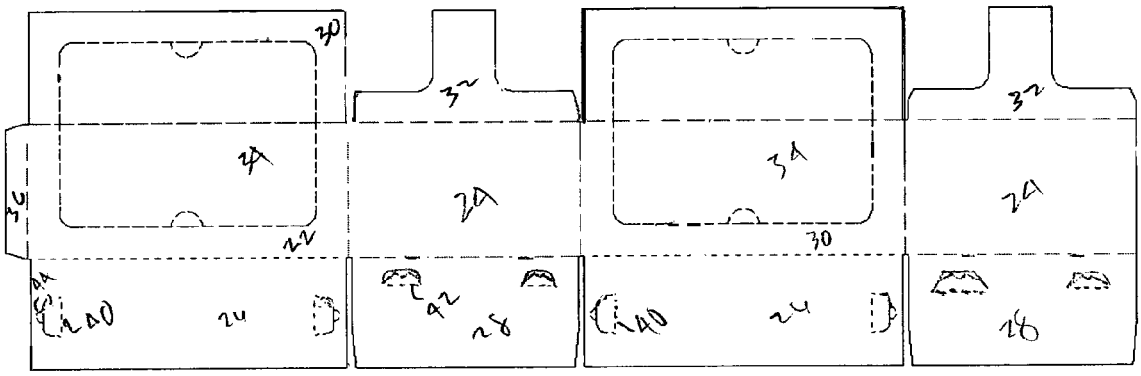
FIG. 2 is a plan view of yet another exemplary container blank.

FIG. 1 depicts a blank 20 used to form the container 50. The blank 20 is typically constructed from a single piece of formable material such as, without limitation, sheets of cellulose-based material formed from cellulose materials such as wood pulp, straw, cotton, bagasse, or the like. Cellulose-based materials used in the present invention may come in many forms, such as fiberboard, containerboard, corrugated containerboard and paperboard. It will be appreciated that other materials may be used. For example, a polymer based material may be used. The polymer based material may be in any form, such as, without limitation, a plastic sheet or corrugated plastic sheet.

The blank 20 is cut and scored, perforated or otherwise formed into a plurality of panels that, when assembled, form container 50. In all FIGURES, like numbers indicate like parts; additionally, cut lines are shown as solid lines, score lines as dashed lines, and lines of perforation as broken lines. For the purposes of further description herein, the downward direction is defined as a direction perpendicular to the first bottom panel 26 when the container 50 has been erected. The upwards direction is defined as the direction perpendicular to the first bottom panel 26 that corresponds to the inner surface of the bottom panel when the container 50 has been erected.

Referring to FIG. 1, the blank 20 includes first side panels 22. The first side panels 22 are generally rectangular in shape. However, it is understood that the first side panels 22 may be of a different geometric shape, such as, without limitation, square. The periphery of the first side panels 22 is generally defined by fold lines 21, 23, and 25. Additionally, one first side panel 22 is bounded by a fold line 36 and the other is bounded by a fold line 31. Attached to first side panel 22 along the fold line at 21 is a second side panel 24. As depicted in the FIGURES, the second side panel 24 is rectangular in shape; however, it is appreciated that the second side panel may also be of a different geometric shape. It will be appreciated that the general size and shape of the relative first side panels 22 and second side panels 24 is largely one of design choice.

Attached to the first side panel 22 along a fold line 25 is a first bottom panel 26. Additionally, attached to the first side panel 22 along a fold line 23, opposite fold line 25, is a first top panel 30. It will be understood that the overall shape of the respective first bottom panels 26 and first top panels 30 will be dictated via the selected geometric shape of their respective first side panel 22 and second side panel 24. Still further, attached to one of the first side panels 22 along a fold line 27 is a manufacturer's joint panel 36 that is attached to one of the first side panels. Those skilled in the art will appreciate that the manufacture's joint panel 36 may be of any suitable size, shape, or configuration so long as it provides an adequate base for locking the first side panels 22 and second side panels 24 in an erect arrangement with the container 50 is formed.

The second side panel 24 includes a second top panel 32 attached thereto along a fold line 31. In overall shape, the second top panel is generally an inverted T-shape. The overall length of the second top panel measured at and along fold line 31 is substantially the same as the length of the second side panel 24 measured at and along the same fold line 31. However, as you move in a direction away from fold line 31, the second side panel 32 narrows substantially symmetrically along both sides such that the second top panel has a length distal from fold line 31 that is substantially less than the length of the second top panel 32 at fold line 31.

The second side panel 24 includes a second bottom panel 28 attached thereto along a fold line 29, opposite fold line 31. As with the first bottom panel 26 discussed above, the second bottom panel's overall geometry is a function of the size and geometry of the second side panel 24. It will be appreciated that the overall size and shape of both the first bottom panel 26 and the second bottom panels 28 will be such that when the container 50 is erected, the respective bottom panels will substantially close off the entire bottom portion of the container 50.

Formed in the first side panel 22 and first top panel 30 is a punch-out window panel 34 that is defined by a perforation line 37. As depicted in the figures, the punch-out window panel 34 is substantially rectangular in shape. However, it will be appreciated that those skilled in the art may change the overall shape and geometry of the punch-out window panel 34 depending upon a variety of factors such as, without limitation, the overall size and shape of the container 50 as well as the product that is being contained therein.

The first bottom panel 26 and the second bottom panel 28 include stacking tab structure. Specifically, in the embodiment disclosed in FIG. 1, the first bottom panel 26 includes stacking tab slots 40. Additionally, the second bottom panel 28 includes stacking tabs 42. Those skilled in the art will appreciate that the relative positioning of the stacking slots 40 and the stacking tabs 42 within their respective panels will be configured and positioned such that when the container is erected the stacking tabs 42 align with and may be configured to protrude through the stacking slots 40.

The first top panels 30 and second top panels 32 are configured such that the relative panels interact to allow them to substantially close the top portion of the container 50 once it is erected. Specifically, as mentioned above, the second top panel 32 includes profiles that are formed along the outer periphery to form a substantially centrally located column extending away from the second side panel—the previously mentioned inverted T-shape. Additionally, the first top panel 30 includes the punch-out window panel 34. The punch-out window panel 34 is configured such that when it is removed it leaves the first top panel 30 as a substantially U-shaped member. The outer portion of the U-shaped member of the first top panel 30 is configured to cooperate with the substantially centrally located protrusion on the second top panel 32 such that the respective panels provide support to one another as the container 50 is erected and the top panels are closed. It will be appreciated that once the punch-out window panel 34 is removed, the design of the various top panels will still provide strength to the container 50 while permitting viewing of the products (not shown) placed in the container 50. It will be further appreciated that the punch-out window panel 34, may be completely removed, or cut out of the blank 20 when the blank 20 is formed.

With respect to FIG. 2, a slightly modified version of the blank of FIG. 1 is depicted. This alternative embodiment includes an alternative arrangement for the stacking stock tabs 42 and stacking slots 40. Specifically in this embodiment, the stacking tabs 42 are formed in the first bottom panel 26 and the stacking slots 40 are formed in the second bottom panel 28. For simplicity purposes only, the rest of the discussion regarding the present invention the blank depicted in FIG. 1 will be used for discussion; however, it will be appreciated that the scope of the present invention also includes a container formed from the blank of FIG. 2, although it is not shown.

Figure 3:
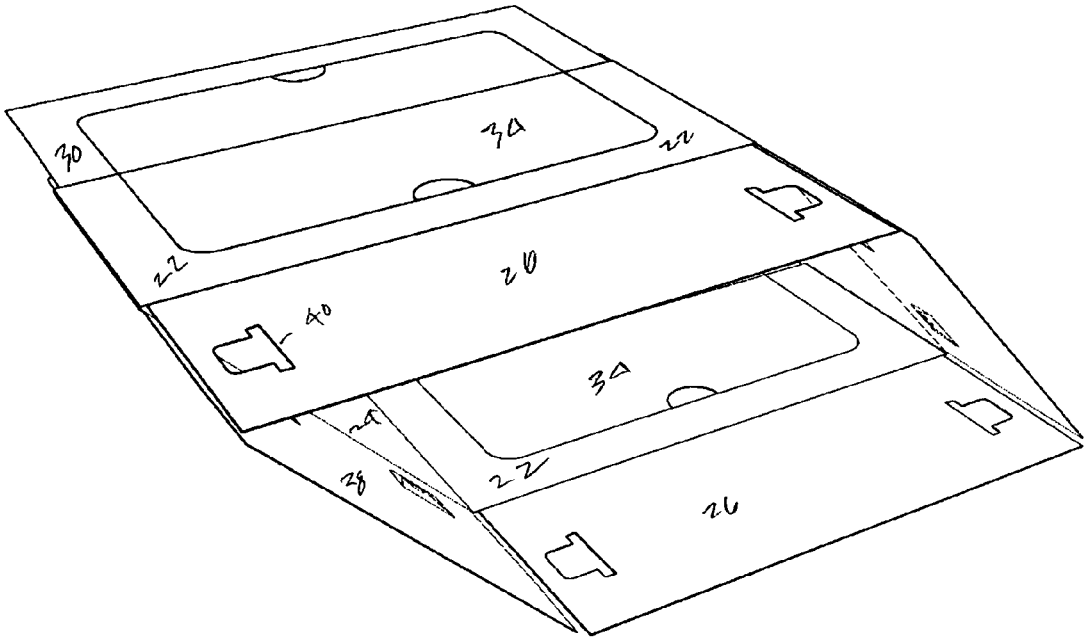
FIG. 3 is a perspective view of a partially assembled container made from the container blank of FIG. 1.
Figure 5:
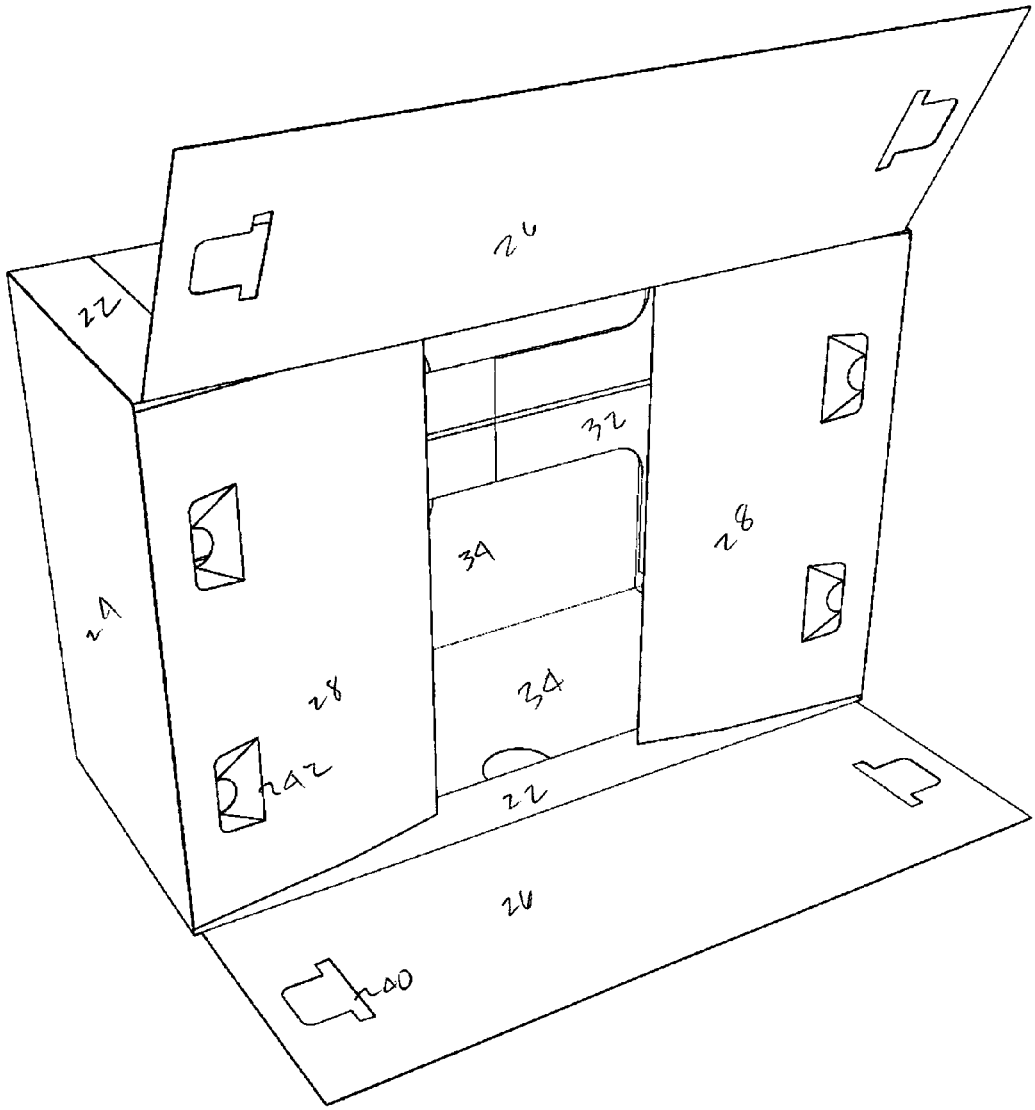
FIG. 5 is another perspective view of a further assembled container made from the container blank of FIG. 1.

With respect to FIGS. 3 through 5, certain aspect of erecting the container 50 are shown. Specifically, the relative first side panels 22 and second side panels 24 are folded around their respective fold lines such that manufacturer's joint panel 36 is brought into juxtaposed association with the respective second side panel 24. Subsequently, the panels are joined in an acceptable manner that will hold the manufacture's joint panel 36 juxtaposed the second side panel 24. Suitable methods of fastening the panels include using adhesives or mechanical fasteners such as brads or staples. Further, other known fastening means may be included without departing from the spirit and scope of this invention.

After the manufacturer's joint panel 36 is suitably attached to the respective second side panel 24, the various second bottom panels 28 and first bottom panel 26 may be folded in along fold lines 29 and 25, respectively. Additionally, as best seen in FIG. 5, the respective first top panel 30 and second top panel 32 may be folded in along their respective fold lines 23 and 31 to close off the top portion of the container 50.

Figure 6:
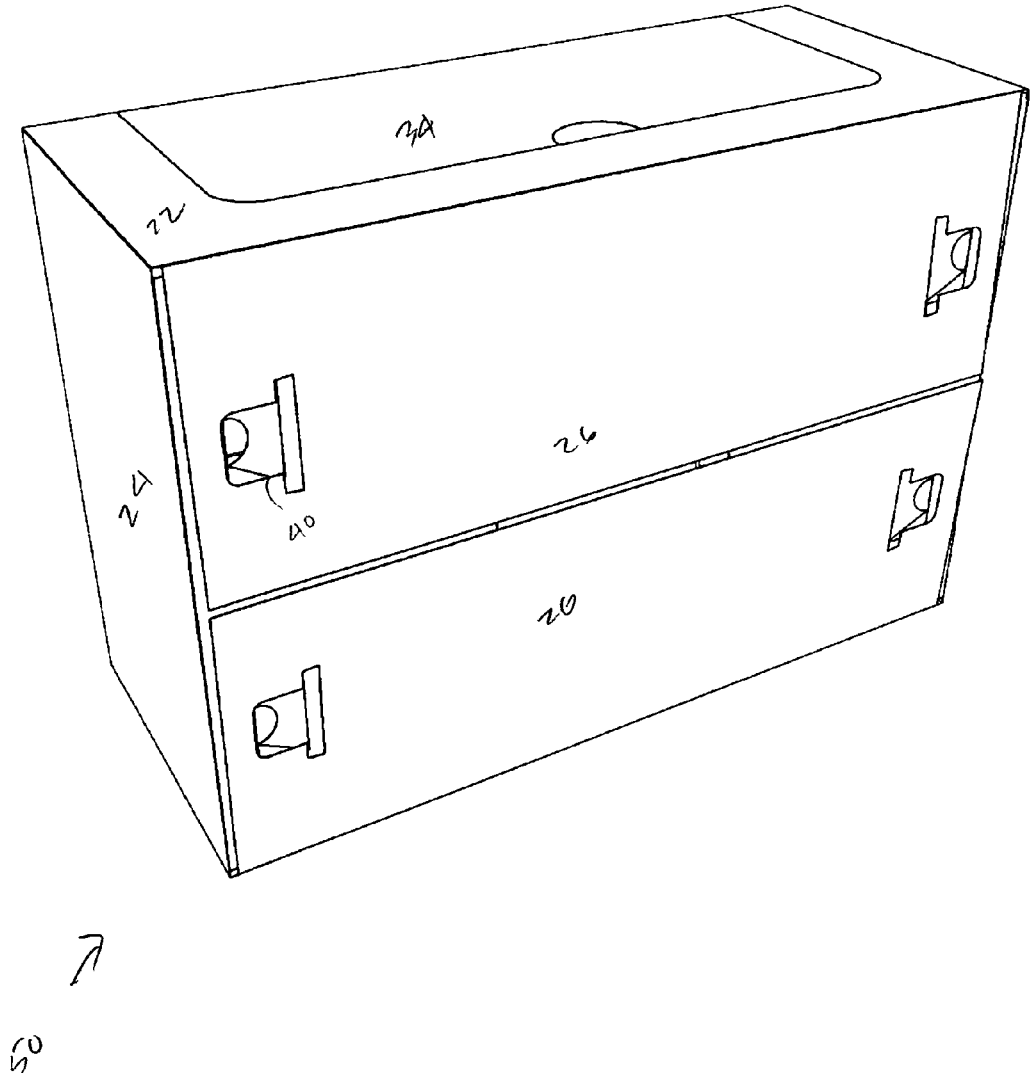
FIG. 6 is a perspective bottom view of a formed container made from the blank of FIG. 1.
Figure 7:
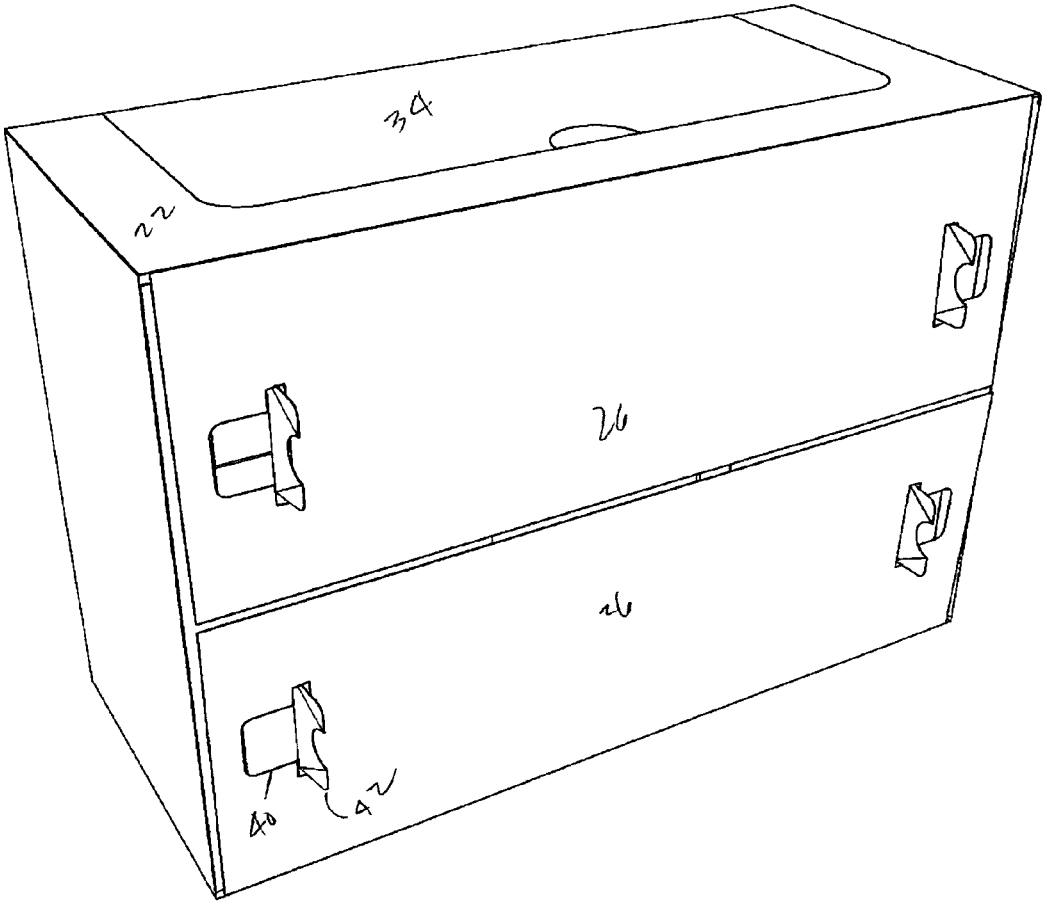
FIG. 7 is another exemplary perspective bottom view of the container formed from the blank of FIG. 1.
Figure 8:
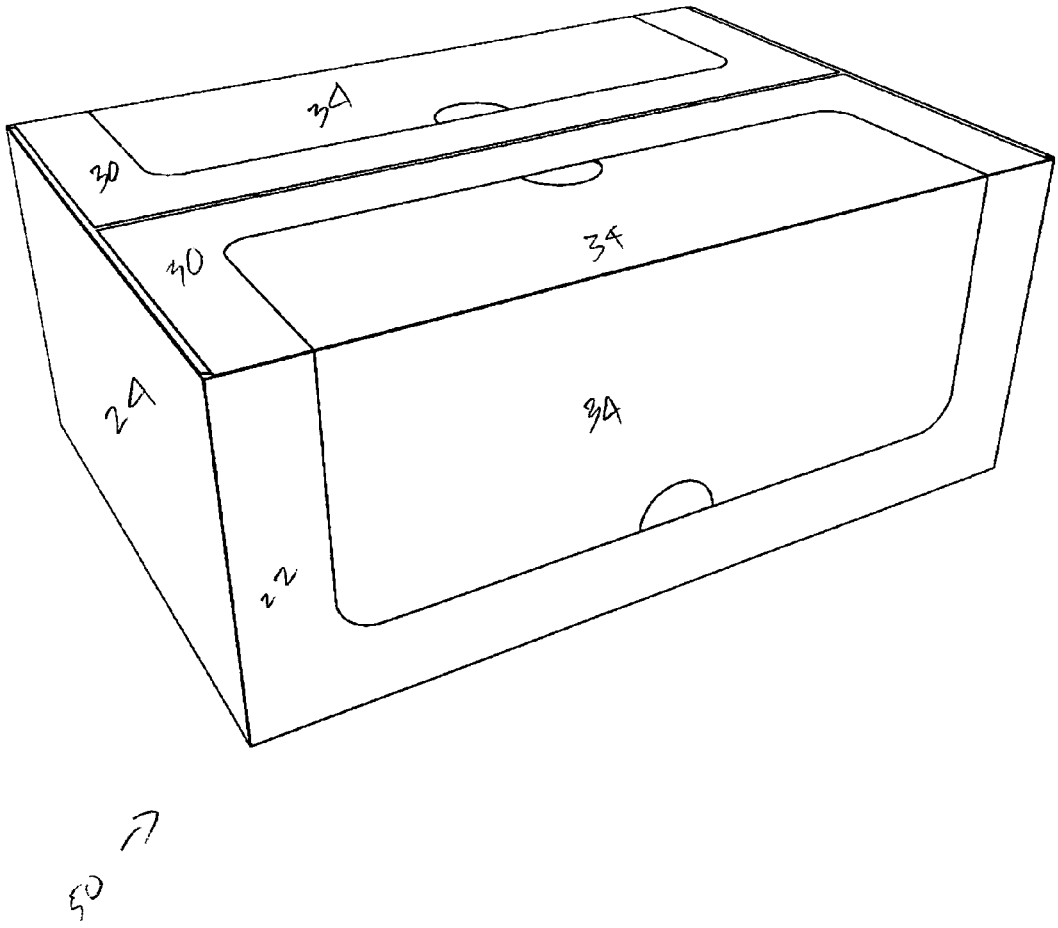
FIG. 8 is a perspective view of the container made from the blank of FIG. 1.
Figure 9:
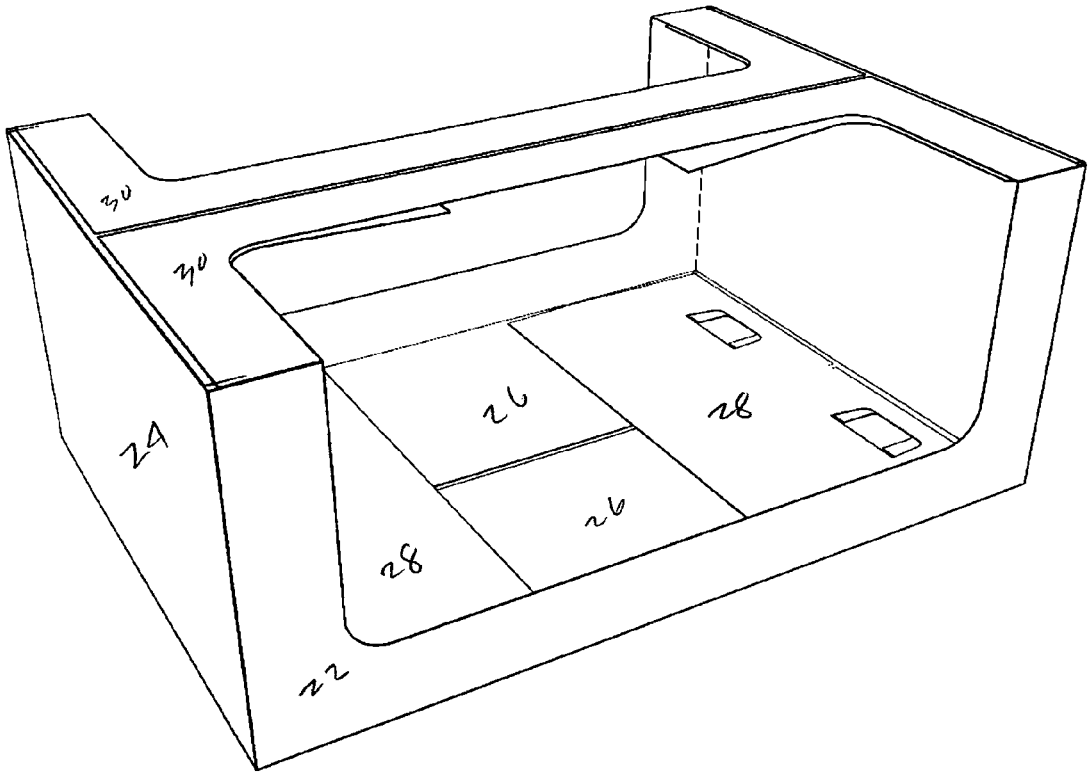
Figure 10:
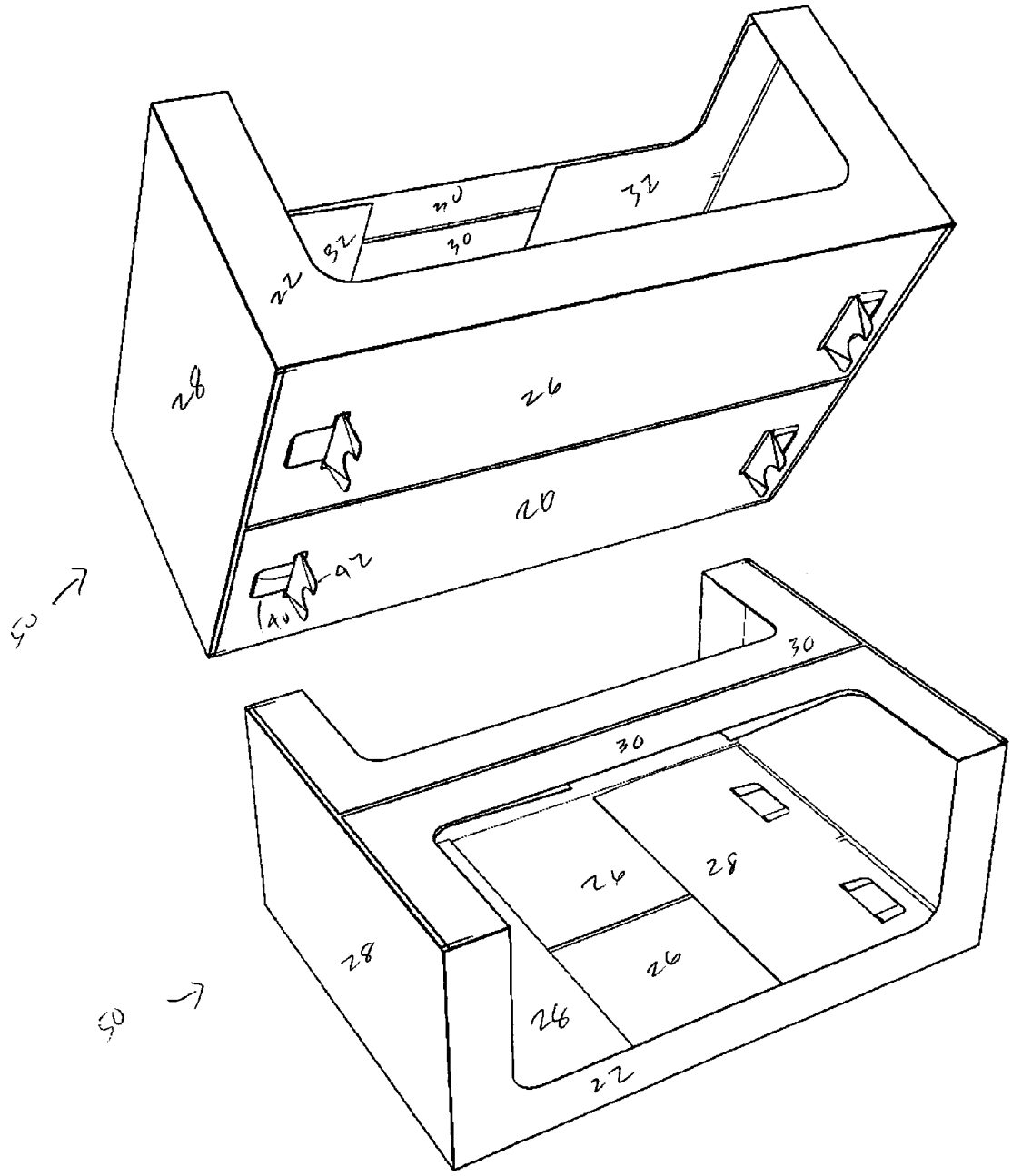
FIG. 10 is a perspective view of a stacking container arrangement according to the present invention.
Figure 12:
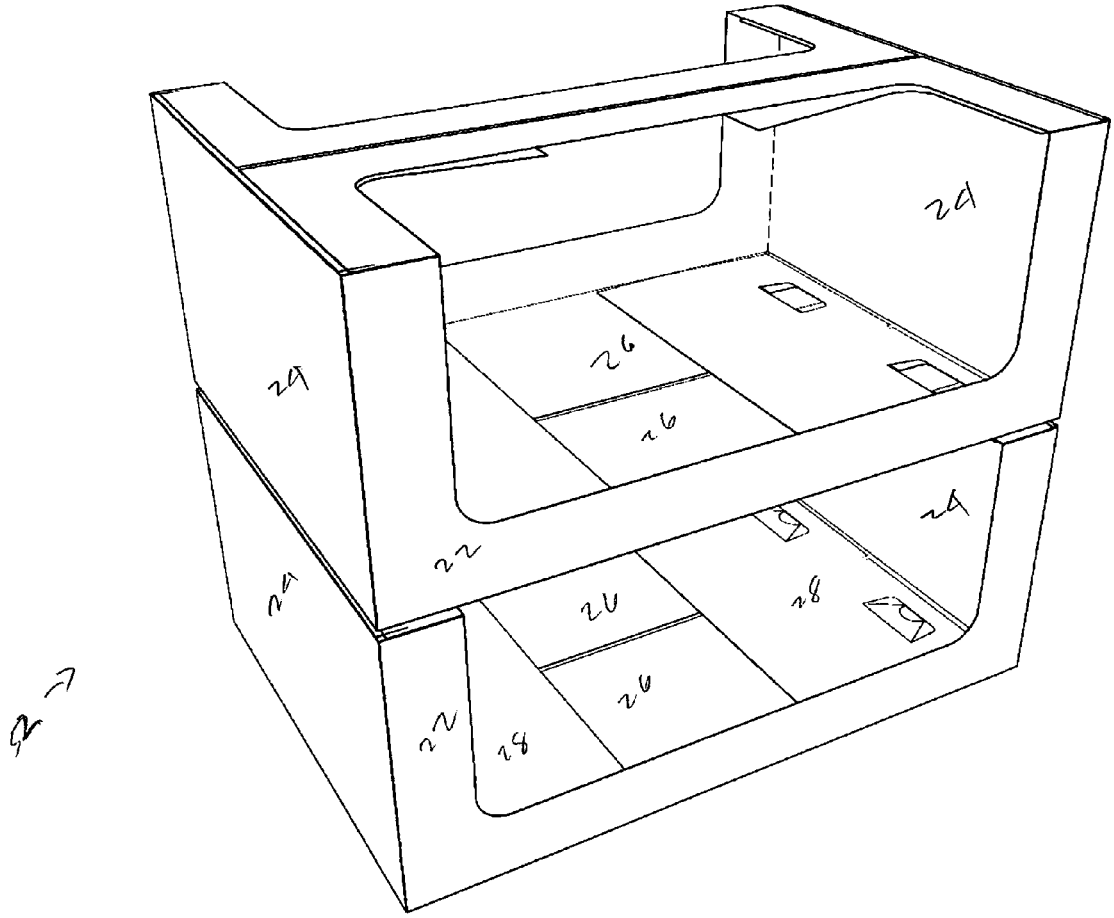
FIG. 12 is a perspective view of an exemplary arrangement of containers stacked upon one another; and, FIG. 13 is yet another exemplary bottom perspective view of the containers and stacking features made in accordance with this invention.
Figure 13:
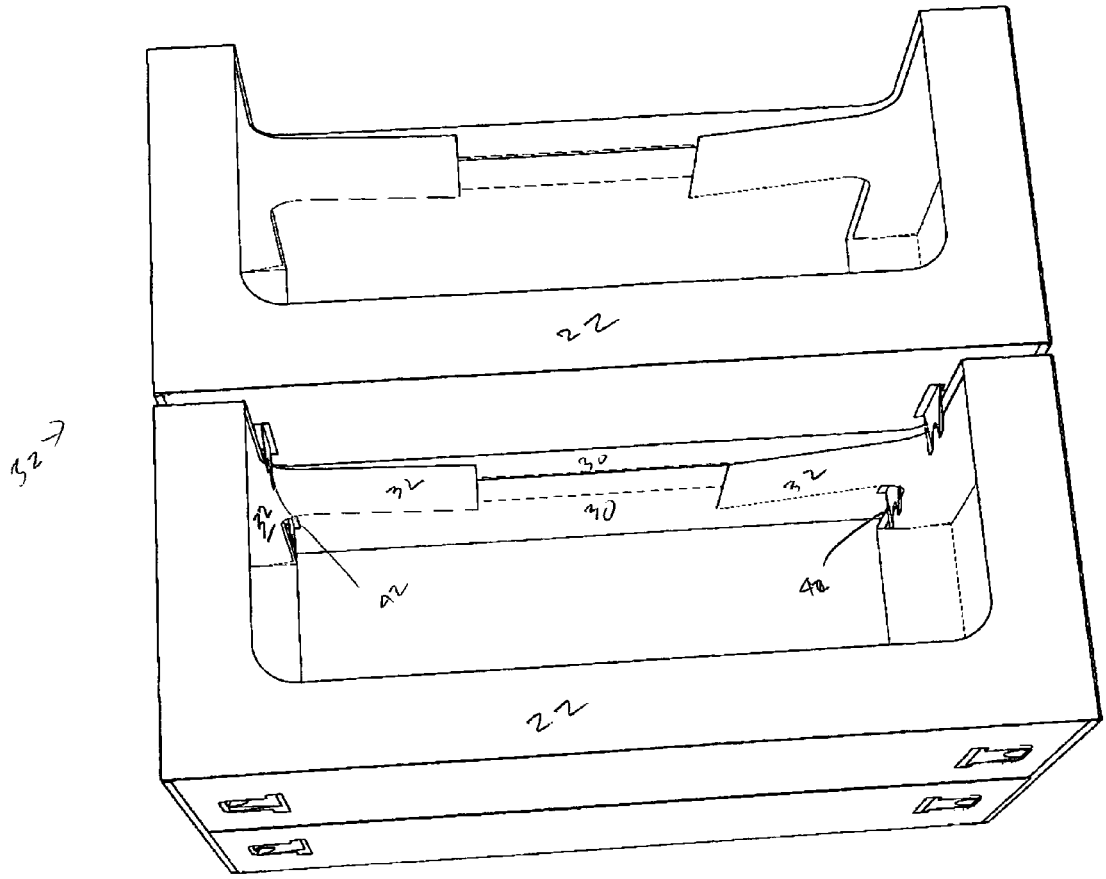

With respect to FIGS. 6 through 8, various aspects of the formed container 50 are disclosed. Specifically as best shown in FIG. 6, the container 50 is shown with the first bottom panel 26 and the second bottom panel 28 wherein the stacking tabs are not employed. However, as best shown in FIG. 7, should a user wish to employ the stacking tab features of the present invention, they may be so used. Specifically, stacking tab 42 in this embodiment is passed through a stacking slot 40 such that stacking tab 42 protrudes in the bottom of the container 50.

Figure 9:
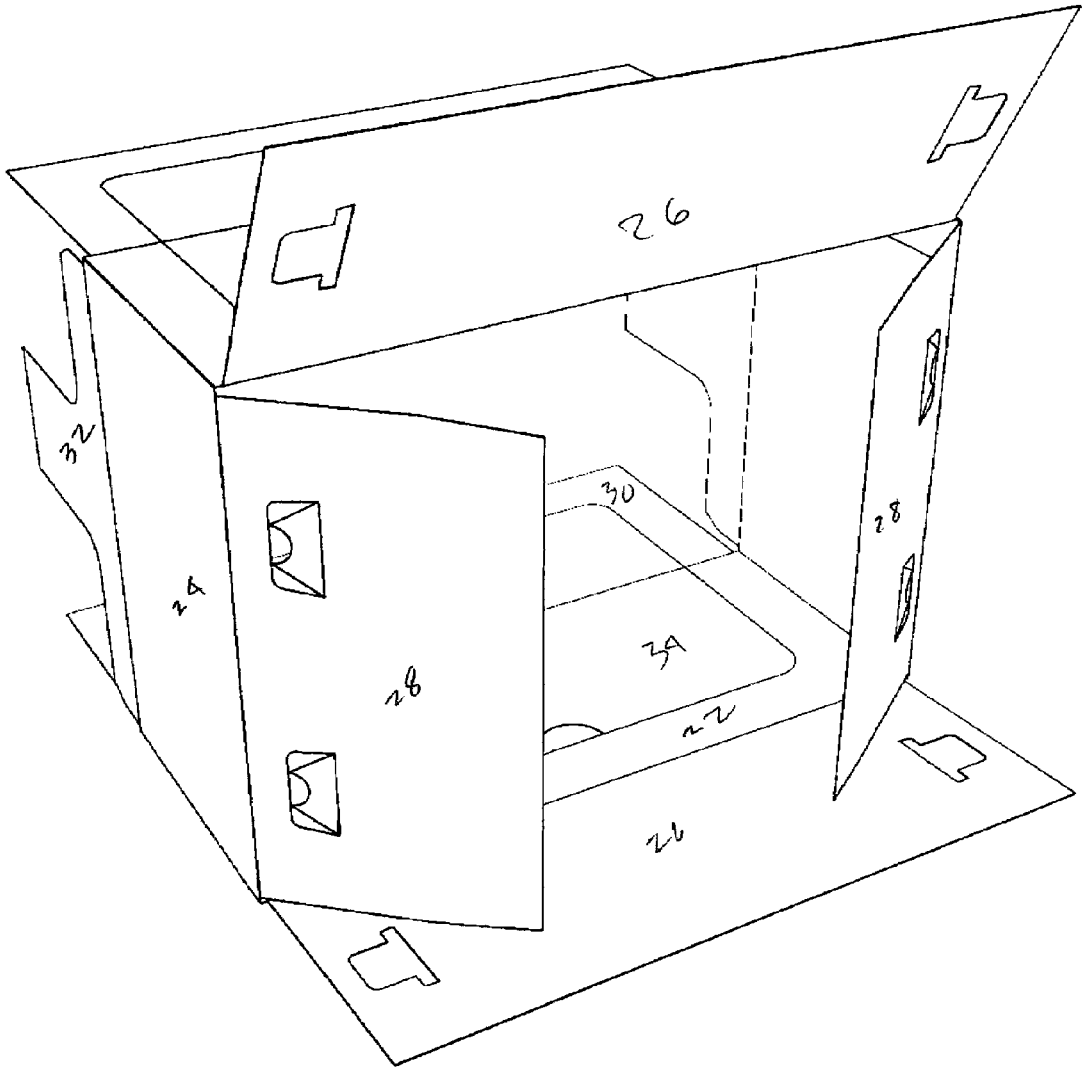
FIG. 9 is an exemplary view of the container made from the blank of FIG. 1, having the viewing panels removed.

FIG. 9 depicts an aspect of the present invention. Specifically, FIG. 9 shows a perspective view of the container 50 formed with the punch-out window panel 34 removed. In this fashion, those skilled in the art will appreciate that any products (not shown) contained within this container may be viewed easily as well as accessed by a user. It will be further appreciated that the container 50 may be used in this mode with either one or both of the punch-out window panels 34 removed.

FIGS. 10 through 14 depict the unique stacking tab arrangement of the present invention more clearly. Specifically, as can be seen in the FIGURES, one container 50 is depicted as being placed in a stacked relationship relative to another container 50. In operation, the stacking tab 42 of a top container 50 "fits" into the open space created by the removal of the punch-out window panel 34. More specifically, the stacking tab 42 "fits" into the open area, and abuts, or substantially abuts the periphery of the first top panel 30. It will be appreciated that this abutment or this connection of stacking tab 42 in association with the first top panel 30 will help prevent the container 50 from displacing while in a stacked position. Those skilled in the art will further appreciate that this stacking tab in the window arrangement improves the overall stability of a vertical column of stacked containers 50 or a container stack 52 as best depicted in FIG. 14.

While various embodiments of the invention have been illustrated and described, as noted above, many changes can be made without departing from the spirit and scope of the invention. Accordingly, the scope of the invention is not limited by the disclosure of such embodiments. Instead, the invention should be determined entirely by reference to the claims that follow.

What is claimed is:

1. A single sheet of foldable material cut and scored to define a container blank, comprising:

a first side panel;

a second side panel connected with the first side panel along a first fold line;

a first top panel connected with the first side panel along a second fold line;

a first bottom panel connected with the first side panel along a third fold line;

a second top panel connected with the second side panel along a fourth fold line;

a second bottom panel connected with the second side panel along a fifth fold line;

a removable panel formed in the first side panel and the first top panel, said removable panel defining an inner periphery of the first top panel;

a rotatable stacking tab formed in one of said first bottom panel or said second bottom panel the tab being attached to the bottom panel by a sixth fold line; and, a stacking slot formed in the other of said first bottom panel or said second bottom panel;

wherein said stacking tab and said stacking slot are positioned in either said first bottom panel or second bottom panel remote from the third fold line or fifth fold line, respectively, and wherein the stacking tab and stacking slot are positioned whereby the stacking tab can extend through the stacking slot into a locking position when the bottom panels are overlapped in an erect container and the stacking tab is rotated around the fold line.

2. The container blank of claim 1, wherein the single sheet of foldable material is formed from a cellulose-based material.

3. The container blank of claim 2, wherein the cellulose based material is formed from at least one of a wood pulp, straw, cotton, and bagasse.

4. The container blank of claim 2, wherein the cellulose based material is in the form of at least one of a fiberboard, containerboard, corrugated containerboard and paperboard.

5. The container of claim 1 wherein a first end of the stacking slot that aligns with the stacking tab fold line in the erect container is wider than a second end of the stacking slot that is removed from the stacking tab fold line whereby the stacking tab will be held in erect position when it is rotated from a plane of bottom panel through the stacking slot.

6. The container of claim 1, wherein the stacking tab fold line is spaced from the third or fifth fold line a distance that allows the stacking tab to rotate about the inner periphery of the opening formed by the removal of the removable panel when the containers are stacked.

7. The container of claim 6, wherein the stacking tab is in the second bottom panel.

8. A container, comprising:

a first side panel;

a second side panel connected with the first side panel along a first fold line;

a first top panel connected with the first side panel along a second fold line;

a first bottom panel connected with the first side panel along a third fold line;

a second top pane connected with the second side panel along a fourth fold line said second top panel being adjacent the first top panel;

a second bottom panel connected with the second side panel along a fifth fold line, said second bottom panel being adjacent the first bottom panel;

a removable panel formed in the first side panel and the first top panel, said removable panel defining an inner periphery of the first top panel;

a rotatable stacking tab formed in one of said first bottom panel or said second bottom panel, the tab being attached to the bottom panel by a sixth fold line; and, a stacking slot formed in the other of said first bottom panel or said second bottom panel;

wherein said stacking tab and said stacking slot are positioned in either said first bottom panel or second bottom panel remote from the third fold line or fifth fold line, respectively, and wherein the stacking tab overlies the stacking slot whereby the stacking tab can extend through the stacking slot into a locking position when the stacking tab is rotated around the fold line.

9. The container of claim 8, wherein the single sheet of foldable material is formed from a cellulose-based material.

10. The container of claim 8, wherein the cellulose based material is formed from at least one of a wood pulp, straw, cotton, and bagasse.

11. The container of claim 8, wherein the cellulose based material is in the form of at least one of a fiberboard, containerboard, corrugated containerboard and paperboard.

12. The container of claim 8, wherein a first end of the stacking slot that aligns with the stacking tab fold line in the erect container is wider than a second end of the stacking slot that is removed from the stacking tab fold line whereby the stacking tab will be held in erect position when it is rotated from a plane of bottom panel through the stacking slot.

13. The container of claim 8, wherein the stacking tab fold line is spaced from the third or fifth fold line a distance that allows the stacking tab to rotate about the inner periphery of the opening formed by the removal of the removable panel when the containers are stacked.

14. The container of claim 13, wherein the stacking tab is in the second bottom panel.

* * * * *